US007214025B2

(12) United States Patent
Rudolph

(10) Patent No.: US 7,214,025 B2
(45) Date of Patent: May 8, 2007

(54) LIFTING APPARATUS FOR SCAFFOLD AND METHOD

(76) Inventor: David Rudolph, 7579 Blanche Pl., Roscoe, IL (US) 61073

( * ) Notice: Subject to any disclaimer, the term of this patent is extended or adjusted under 35 U.S.C. 154(b) by 393 days.

(21) Appl. No.: 10/635,157

(22) Filed: Aug. 6, 2003

(65) Prior Publication Data

US 2004/0026170 A1 Feb. 12, 2004

Related U.S. Application Data

(60) Provisional application No. 60/401,657, filed on Aug. 6, 2002.

(51) Int. Cl.
*E04G 1/18* (2006.01)

(52) U.S. Cl. ..... 414/607; 186/63

(58) Field of Classification Search ..... 414/461, 414/462, 785, 607; 182/63
See application file for complete search history.

(56) References Cited

U.S. PATENT DOCUMENTS 2,314,792 A * 3/1943 Korner ..... 294/67.22
3,504,461 A * 4/1970 Copeland et al. ..... 52/123.1
3,552,557 A * 1/1971 Green ..... 414/607
3,602,382 A * 8/1971 Anderson ..... 414/740
4,216,933 A * 8/1980 Cramer, Jr. ..... 248/188.5
4,471,989 A * 9/1984 Taylor ..... 294/81.21
4,537,283 A * 8/1985 Humes ..... 182/127
4,708,576 A * 11/1987 Conley ..... 414/607
5,012,894 A * 5/1991 Nelson ..... 182/179.1
5,088,577 A * 2/1992 Pierce ..... 182/179.1
5,370,435 A * 12/1994 Monk et al. ..... 294/81.54

* cited by examiner

*Primary Examiner*—Charles A. Fox
(74) *Attorney, Agent, or Firm*—Reinhart Boerner Van Deuren P.C.

(57) ABSTRACT

A lifting apparatus to facilitate lifting and maneuvering of a scaffold or the like by a forklift is provided. The lifting apparatus includes two identical portions, each portion including two end structure portions and a backbone portion. The end structure portions removably secure the lifting apparatus to the scaffold. The backbone portion is adapted to accommodate the width of the working platform of a scaffold, to link the end structure portions together, and to provide locations for a forklift to attach to the lifting apparatus. The lifting apparatus is adapted to allow the forklift to align perpendicular or parallel to the length of the scaffold. Furthermore, the lifting apparatus aligns the lifting structure of the scaffold with the center of mass of the scaffold.

17 Claims, 11 Drawing Sheets

LIFTING APPARATUS FOR SCAFFOLD AND METHOD

CROSS-REFERENCE TO RELATED PATENT APPLICATIONS

This patent application claims the benefit of U.S. Provisional Patent Application No. 60/401,657, filed Aug. 6, 2002, the teachings and disclosures of which are incorporated herein in their entireties by the reference hereto.

FIELD OF THE INVENTION

The present invention relates generally to lifting attachments, and more particularly to apparatus for maneuvering and lifting scaffolds and the like.

BACKGROUND OF THE INVENTION

Large hydraulic scaffolds are commonly used in the construction industry to allow workers to be properly positioned at the worksite to accomplish their task. Generally, the workers are constructing or working on a wall of a building or structure. As the work progresses, the hydraulic scaffold may be raised or lowered as required to re-position the workers and to acquire and off load additional materials. These hydraulic scaffolds provide a significant advantage over rigid scaffold, which is typically constructed in a fixed manner. Once constructed, the rigid scaffold requires that the workers climb up and down the skeleton of the scaffold to reach the work platforms. The skeleton of the platform must also be manually constructed and destructed to relocate the scaffold as the work progresses at the construction site.

A typical base scaffold unit includes a working platform section, hydraulic motors, lifting towers, etc. The length of the working platform of the hydraulic scaffold assembly may be expanded quite extensively by adding additional scaffold units to the base scaffold unit. An industrial-strength extendible-boom forklift is typically used to move the hydraulic scaffold and assemble the sections to form the scaffold assembly. To facilitate the lifting of these various scaffold sections, each scaffold unit includes pre-installed forklift tang receptacles on the edge and under the scaffold platform. These receptacles are positioned about the center of the length of the scaffold unit to accommodate the forklift tangs to facilitate the lifting and movement of that single unit such that the weight of the scaffold is roughly balanced.

When two sections of scaffold are coupled together to extend the working length of the platform, it is still desirable to lift the assembly from the center to balance the weight. However, the positioning of the tang receptacles on one section do not align with those on the other section to accommodate both forklift tangs when attempting to balance the load when lifting the assembly. However, the forklift must be positioned such that the load is balanced on each side of the forklift. Unfortunately, the spacing between the receptacles on each end of the connected sections is wider than the spacing between the forklift tangs. While one forklift tang may be accommodated in a receptacle of one platform portion, the receptacle of the added platform portion is not positioned to allow the other forklift tang to be accommodated therein. As a result, at least one of the tangs of the forklift is not accommodated in a receptacle and the scaffold simply rests on this tang. In this limited controlled configuration, damage to the hydraulic scaffold assembly, the support structures of the scaffold and the forklift may result.

Additionally, even when a single scaffold unit is lifted by a forklift with both tangs properly in the receptacles, the depth of the working platform for a typical hydraulic scaffold is such that a significant torque arm is presented to the forklift. As will be discussed more fully below in relation to FIG. 6, this torque arm is created because the forklift is required to lift the hydraulic scaffold from the side of the working platform. Indeed, this lifting position is furthest from the center of mass of the scaffold when the base scaffold unit is lifted. This is because the hydraulic motors, towers, and lifting mechanism must be positioned adjacent to the building so that the weight of the workers and bricks do not present a significant torque on the lifting structure of the scaffold itself during use. Furthermore, the offset center of mass of the scaffold is a safety feature, because this configuration tends to cause the scaffold to tip towards the building, rather than away from the building. However, the amount of weight and torque presented to the forklift that is lifting the scaffold from the side opposite the center of mass can be significant. The significant torque presented to the forklift by the weight of the scaffold has been known to create stress and fatigue cracking of integral lifting components of the forklift.

Indeed, this torque loading on the forklift resulting from the positioning of the forklift receptacles of these hydraulic scaffolds is such that it is difficult if not impossible to lift a hydraulic scaffold assembly that includes multiple scaffold units. As a result, the scaffold assembly must be taken apart to allow the scaffold to be moved around or to the work site. This assembly and disassembly process wastes significant amounts of time and money.

Not only is the need to assemble and disassembly the scaffold wasteful of time and money, but it is difficult as well. That is, adding and removing additional platform units to a hydraulic scaffold assembly is not aided by the positioning of the tang receptacles. This is because the positioning of the receptacles requires the forklift to be positioned transverse to the direction of movement necessary to add the additional platform unit to the assembly. Specifically, the receptacles require that the forklift be positioned perpendicular to the length of the scaffold unit. However, the scaffold unit must be moved in a direction along its length to be brought into conjunction with another unit. Since a typical forklift cannot move sidewise (perpendicular to the direction that it is facing), it is of little use in constructing the scaffold assembly.

However, since these units are quite heavy, it is most desirable to use the forklift to maneuver these units to aid in their assembly. Currently, in an attempt to use the lifting power of the forklift when assembly multiple units, chains or straps are used. Specifically, the forklift is positioned in-line with the length of the scaffold unit to be moved and chains or straps coupled to the scaffold unit are picked up by the tangs of the forklift. The forklift is then driven forward to bring the scaffold unit into conjunction with another unit. Unfortunately, since neither chains nor straps provide a rigid connection with the platform, the scaffold unit may swing and sway. This severely limits the forklift operator's control over movement and positioning of the additional scaffold unit. This lack of control over the scaffold unit requires additional workers to steady the scaffold unit while it is being lifted and moved into position and to assist in the assembly of the scaffold. Also, if the chains and straps are improperly attached to the platform, structural members of the platform may become damaged. Furthermore, the size of chains required to lift the scaffold are themselves heavy, inconvenient and expensive.

Therefore, there exists a need in the art for a mechanism that facilitates the lifting, movement, assembly, and disassembly of scaffold units that overcomes the above described and other problems existing in the art.

BRIEF SUMMARY OF THE INVENTION

In view of the above, the present invention is directed to a new and improved lifting apparatus particular applicable to scaffolds. More particularly, the present invention is directed to a lifting mechanism that may be removably affixed to a scaffold to facilitate its assembly, lifting, and movement at a work site.

In accordance with an embodiment of the present invention, the lifting apparatus provides two portions, each of which including a backbone portion adapted to the width of the working platform of a scaffold. Each portion includes a forklift tang receptacle, which accommodates a forklift tang. End structure portions at each end of the portions removably affix the lifting apparatus to the working platform of a scaffold. The end structure portions include lifting bars, which extend under the working platform of the scaffold to enable the lifting thereof. In one embodiment, the end structure portions include, in addition to the lifting bar, a top abutment face, which positions above the working platform to facilitate a more secure attachment thereto.

In accordance with another aspect of the invention, the lifting apparatus of the present invention may be positioned almost anywhere along the length of the scaffold. Because the tang receptacles are located above the scaffold when attached thereto, the lifting structure of the forklift may be located approximately in line with the center of mass of the scaffold. This is a major improvement over the prior art which required lifting from the edge of the scaffold. With the present invention, by lifting substantially from the center of mass, the torque arm presented to the lifting structure is substantially reduced. In one embodiment, the tang receptacles are permanently offset along the length of the backbone portion such that the forklift lifting structure is approximately centered over the scaffold. Alternatively, the tang receptacles are removably and/or slidably attached to the backbone portion so that the lifting structure may be more preferably positioned as the location of the center of mass of the lifted scaffold varies with different units. This significant improvement reduces stress on structural components of the forklift allowing the forklift to lift heavier scaffold assemblies, to tilt the scaffold assemblies, and to lift the scaffolds higher.

In accordance with another embodiment of the present invention, transverse tang receptacles are provided to aid in the assembly and disassembly of scaffold units to increase and decrease the total length of the working platform, respectively. The transverse tang receptacles allow the forklift to lift the scaffold section from a position perpendicular to the backbone portions and aligned with the length of the working platform. In this configuration, the forklift easily moves and controls the scaffold unit attached to the lifting apparatus forward or backward to connect or to disconnect the attached scaffold unit to the scaffold assembly, respectively. The increased control and maneuverability provided by the aligned positioning and the rigid and secure connection between the scaffold unit and the forklift created by the lifting apparatus substantially simplifies and allows a single worker to perform these assembly and disassembly processes.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
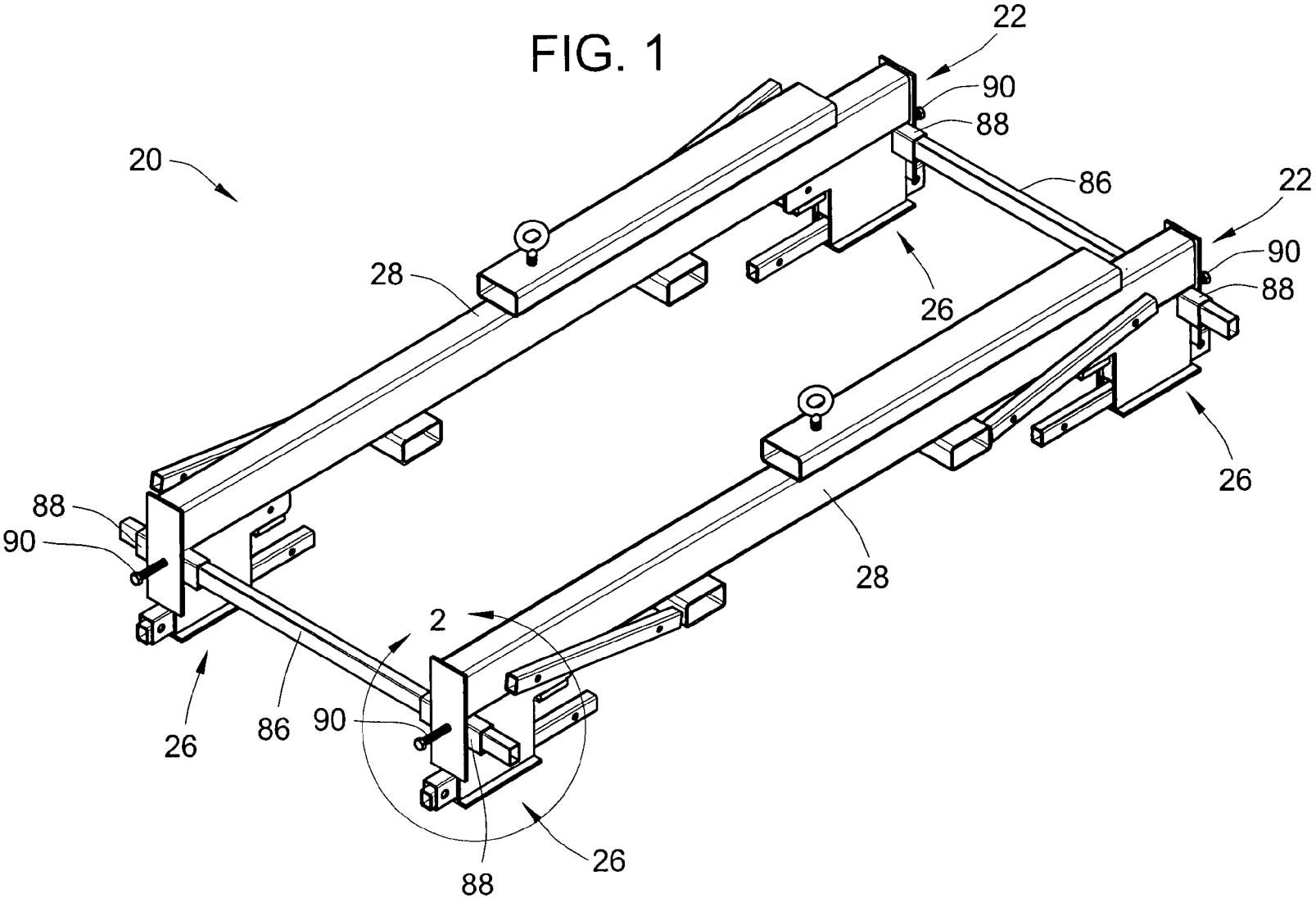
FIG. 1 is an isometric illustration of a lifting apparatus constructed in accordance with the teachings of the present invention.

Turning now to the drawings, there is illustrated in FIG. 1 an isometric illustration of an embodiment of a lifting apparatus 20 constructed in accordance with the teachings of the present invention. In this embodiment the lifting apparatus 20 includes two identical portions or lifting bracket structures 22 adapted to facilitate lifting and maneuvering a scaffold or the like. Each portion 22 includes two end structure portions 26 and a backbone portion 28. The end structure portions 26 are adapted to removably secure the lifting apparatus 20 to a scaffold or platform as will be discussed more fully below. The backbone portion 28 is adapted to accommodate the width of the platform of a scaffold, to link the end structure portions 26 together, and to provide locations for a forklift to attach to the lifting apparatus 20.

In the embodiment illustrated in this FIG. 1, the two portions 22 are adjustably held in relative position to one another by a cross-positioning bar 86 attached to each end of each portion 22, transverse to the backbone portions 28. The cross-positioning bar 86 reduces most torsion forces that may otherwise result from improper positioning of the two portions 22, particularly when lifting heavy or awkward loads. These cross-positioning bars 86 may integrally attach to the portions 22, thereby permanently fixing the lateral spacing. Preferably, these cross-positioning bars 86 slidably attach to the portions 22 allowing the relative position to be adjusted to accommodate forklifts with varying tang spacing and length.

In one embodiment, the end structure portions 26 include cross-positioning bar receptacles 88. The cross-positioning bars 86 are inserted therethrough and secured therein. The illustrated embodiment uses a threaded bolt 90 as a locking mechanism to secure the cross-positioning bar 86 within the cross-positioning bar receptacles 88 and to fix the relative positioning of the two portions 22. This embodiment provides for incremental changes in the lateral spacing. One skilled in the art would realize that the cross-positioning bars 86 are not required elements of the disclosed invention. Furthermore, alternative locking mechanisms, such as pins, clamps, etc. could be used to fix the position of the cross-positioning bars 86.

Figure 2:
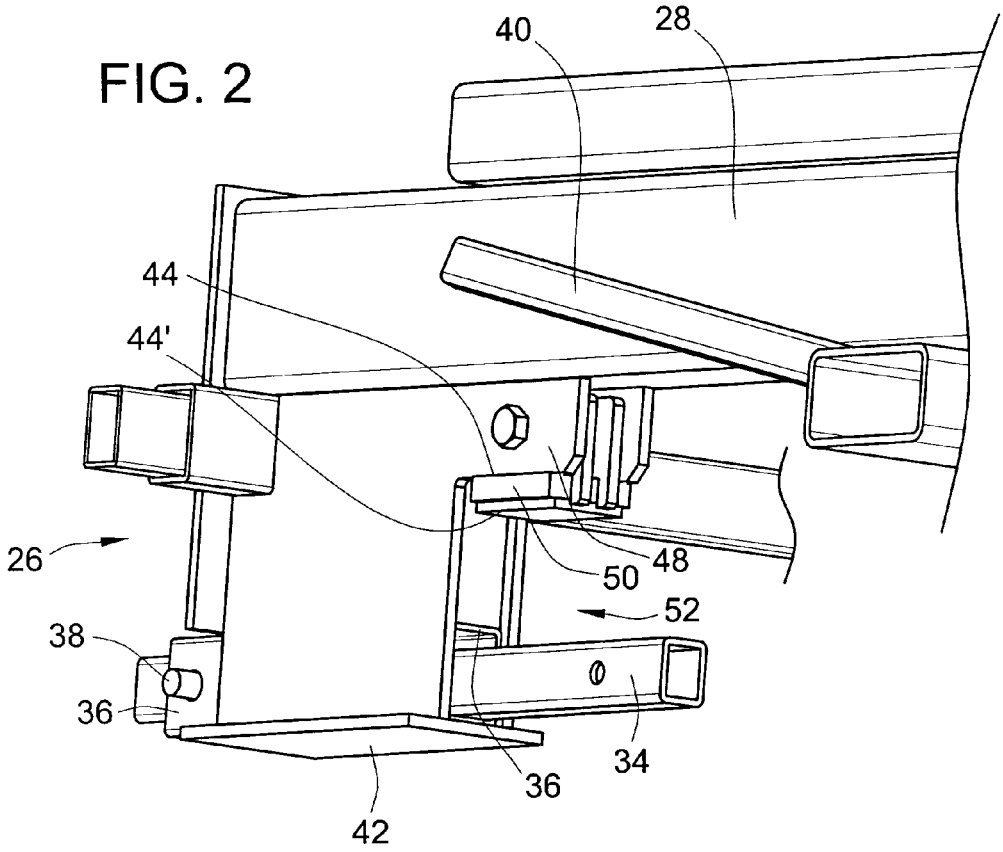
FIG. 2 is an enlarged isometric illustration of an end structure portion of the lifting apparatus of FIG. 1.
Figure 3:
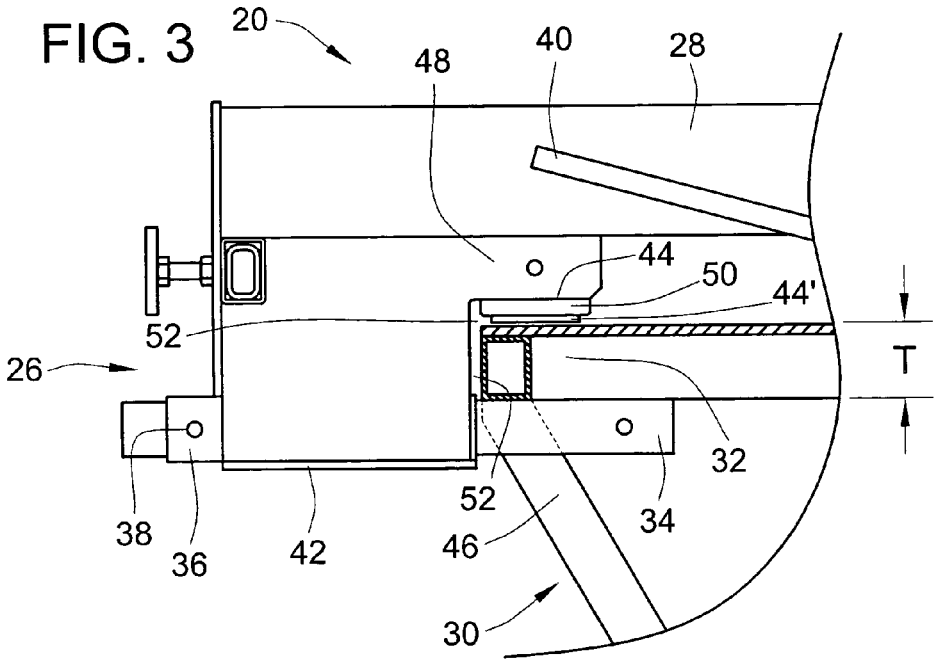
FIG. 3 is a profile illustration of the end structure portion of the lifting apparatus of FIG. 2 attached to a scaffold unit.

Referring to FIGS. 2 and 3, the end structure portion 26 secures the lifting apparatus 20 to a scaffold 30 and more particularly to the scaffold's working platform 32 (see FIG. 3). Each end structure portion 26 carries a lifting bar 34 inserted through and removably attached within a lifting bar receptacle 36. The lifting bar 34 extends under the working platform 32 (see FIG. 3) to enable the lifting of the scaffold 30. A locking mechanism may be used to hold the lifting bar 34 in proper working position. In one embodiment, a locking pin 38 inserted through holes in the lifting bar 34 and lifting bar receptacle 36 removably fix the lifting bar 34 in proper position under the working platform 32 and prevent the lifting bar 34 from becoming dislodged during lifting or moving operations. Other locking mechanisms may be used, such as bolts, clamps, etc. Because the lifting bar receptacle 36 supports the lifting bar 34, the lifting bar receptacle 36 is preferably of a length sufficient to support the weight lifted by the cantilevered lifting bar 34.

Figure 7:
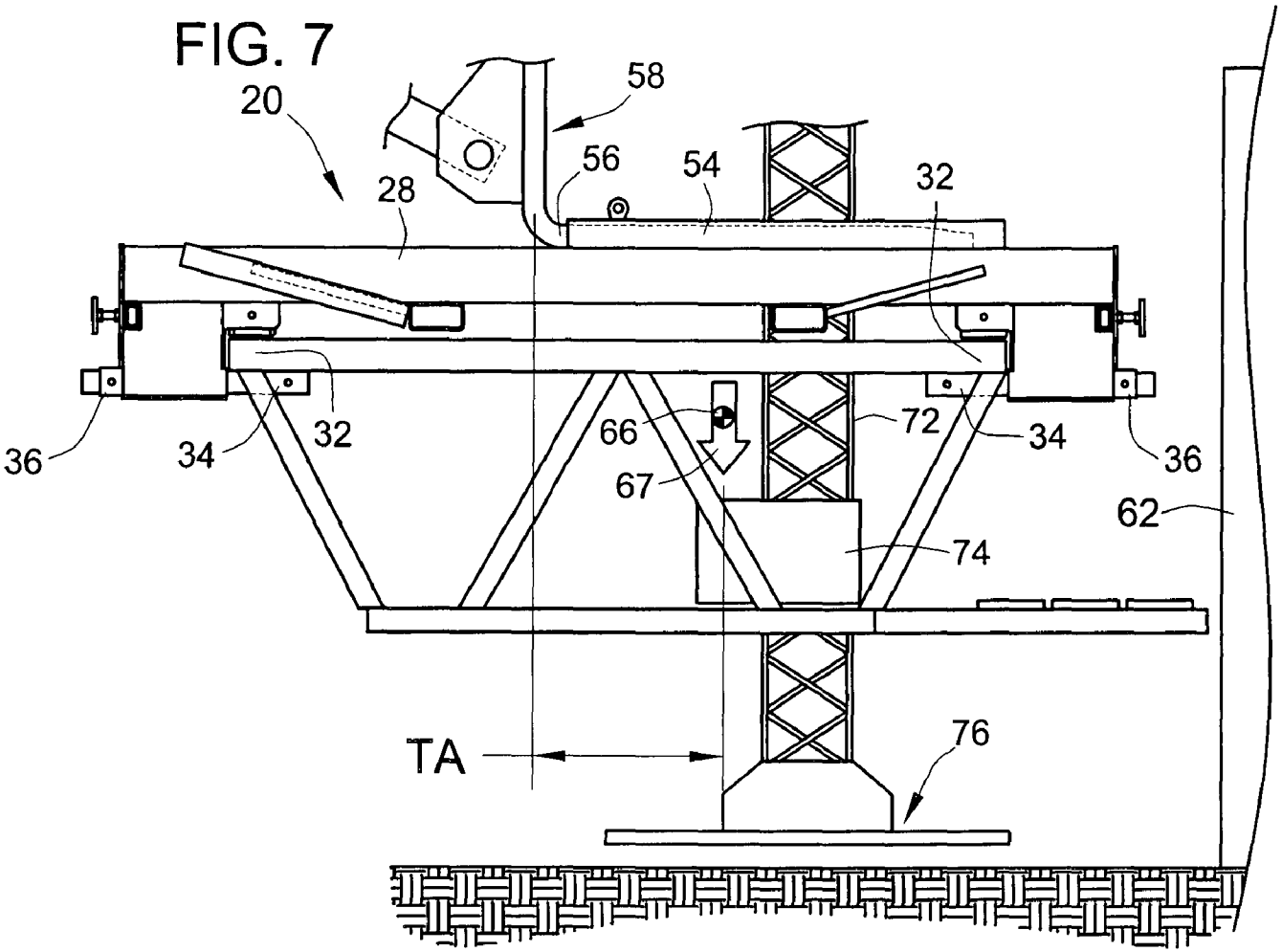
FIG. 7 is a partial profile view illustration of the lifting apparatus of FIG. 1 used with a forklift and scaffold unit.

In one embodiment, the lifting bar 34 is able to slide completely through the lifting bar receptacle 36 to facilitate removal of the lifting bar 34, particularly when placing the scaffold 30 substantially close to a wall or structure (see FIG. 7). If the lifting bar were not allowed to be removed by sliding completely through the lifting bar receptacle 36, thereby sliding under the working platform 32, the wall or structure 62 may obstruct the removal of the lifting bar 34. Preventing removal of the lifting bar 34 may obstruct the lifting apparatus 20 from being removed from the scaffold 30.

When the lifting apparatus 20 is not attached to the scaffold, the lifting bar 34 may be placed on or in a lifting bar holder 40, thereby providing a convenient receptacle for storing the lifting bar 34 with the lifting apparatus 20. This lessens the likelihood that the lifting bar 34 will become lost or damaged. In one embodiment, the lifting bar holder 40 is a rod over which the lifting bar 34 slides. The holder 40 could comprise many alternatives, including clamps, receptacles, chains, pins, etc.

As may also be seen in these FIGS. 2 and 3, an embodiment of the present invention includes a support pad 42 located on the bottom of the end structure portion 26. This support pad 42 provides additional rigidity and strength to this end structure 26. In a preferred embodiment, the support pad 42 is wider than the end structure portion 26 to increase the stabilization of the lifting apparatus 20 when it is placed on the ground. This may be particularly important when the two portions are not coupled together by the cross-positioning bar 86 (see FIG. 1).

To attach the end structure portions 26 to the working platform 32 more rigidly, and thereby provide more controlled lifting and enable more precise maneuvering of a scaffold, an embodiment of the present invention includes an end structure portion 26 that includes a top abutment surface 44. The top abutment surface 44 prevents the working platform 32 from substantially moving relative to the lifting apparatus 20, particularly if the forklift hits a bump or hole causing the working platform 32 to bounce. Limiting movement also reduces damage of the working platform 32, structural support members 46, the lifting apparatus 20 and the forklift. To accommodate scaffolds 30 having various working platform 32 thicknesses T (see FIG. 3), a preferred embodiment incorporates a combination of top abutment surfaces 44, 44' by including a step 48 defined by the end structure portion 26 and removably attached shims 50. With the shims 50 removed, a gap 52 between the lifting bar 34 and top abutment surface 44, which is defined by the step 48, accommodates scaffolds 30 having thicker working platforms 32. To provide a more secure attachment when lifting scaffolds 30 having thinner working platforms 32, a shim 50, which defines top abutment surface 44', is removably attached to the end structure 26 to reduce the gap 52 between the step 48 and the lifting bar 34. In alternative embodiments, the underside of the backbone portion 28 could function as a top abutment surface.

Figure 4:
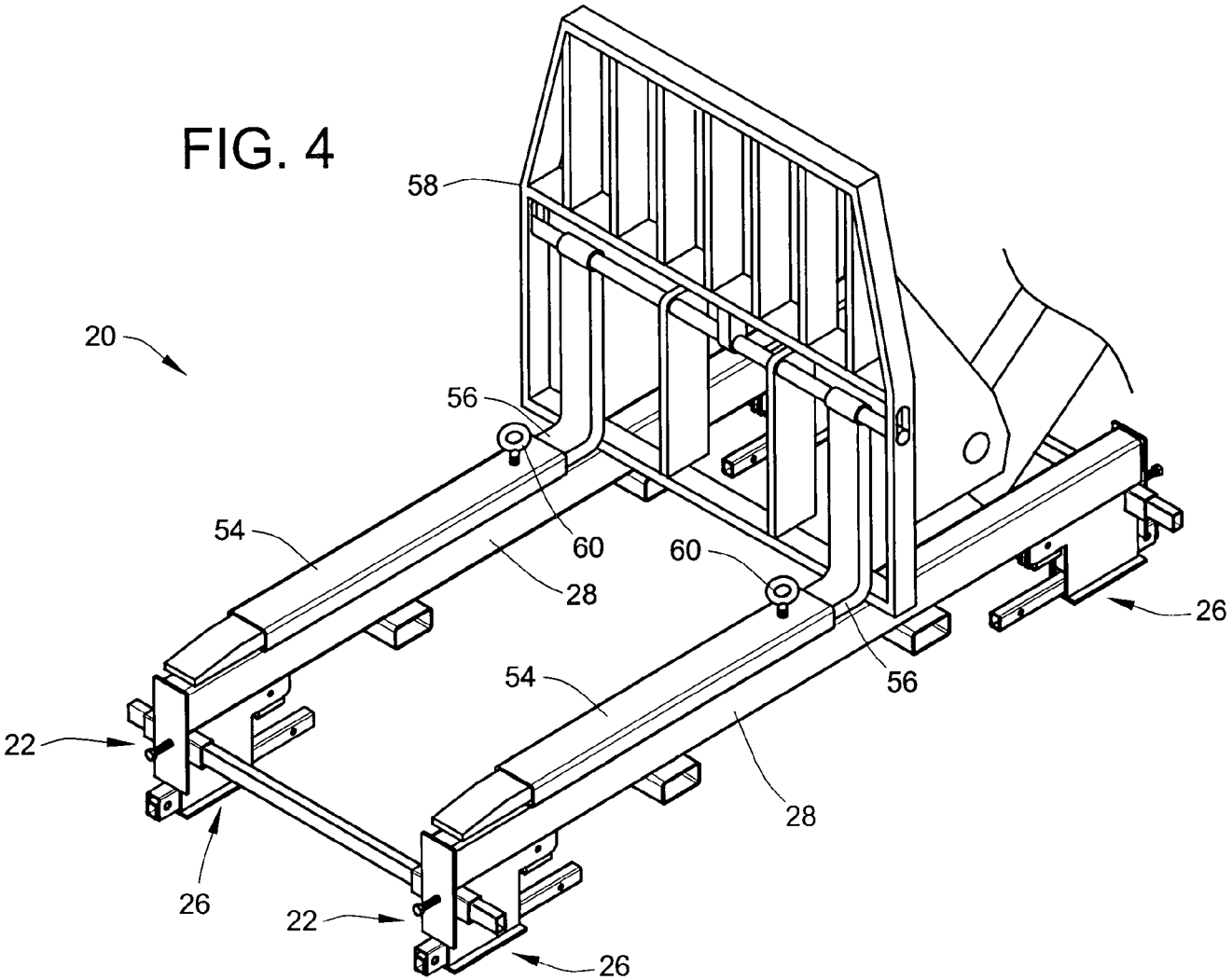
FIG. 4 is an isometric illustration of the lifting apparatus of FIG. 1 used with a forklift.

Referring now to the isometric illustration of FIG. 4, each portion 22 includes a tang receptacle 54 adapted to receive a forklift tang 56 for attaching the lifting apparatus 20 to a forklift lifting structure 58 of a forklift. The tang receptacles 54 allow a forklift to lift, to move, or to position the scaffold. In a preferred embodiment, the tang receptacle 54 is on an upper surface of the backbone portion 28 making the tang receptacle 54 very accessible to the forklift tang 56. In addition, the tang receptacle 54 is preferably axially offset along the length of the backbone portion 28 such that one end of the tang receptacle 54 is approximately centered relative to the length of the backbone portion 28. As illustrated, the forklift tang 56 is inserted into the tang receptacle 54. In a preferred embodiment, the inner periphery of each tang receptacle 54 provides a close fit between the tang receptacle 54 and the inserted forklift tang 56. The close fitting configuration reduces lateral and vertical movement of the forklift tang 56 within the tang receptacle 54, thereby increasing control over the lifting apparatus 20 and reducing damage thereto. Safety chains (not illustrated) may be attached between the forklift lifting structure 58 and the lifting apparatus 20 to provide added security and safety. Eye bolts 60 mounted on top of the tang receptacles 54 provide convenient attachment points on the lifting apparatus 20 for safety chains.

Figure 5:
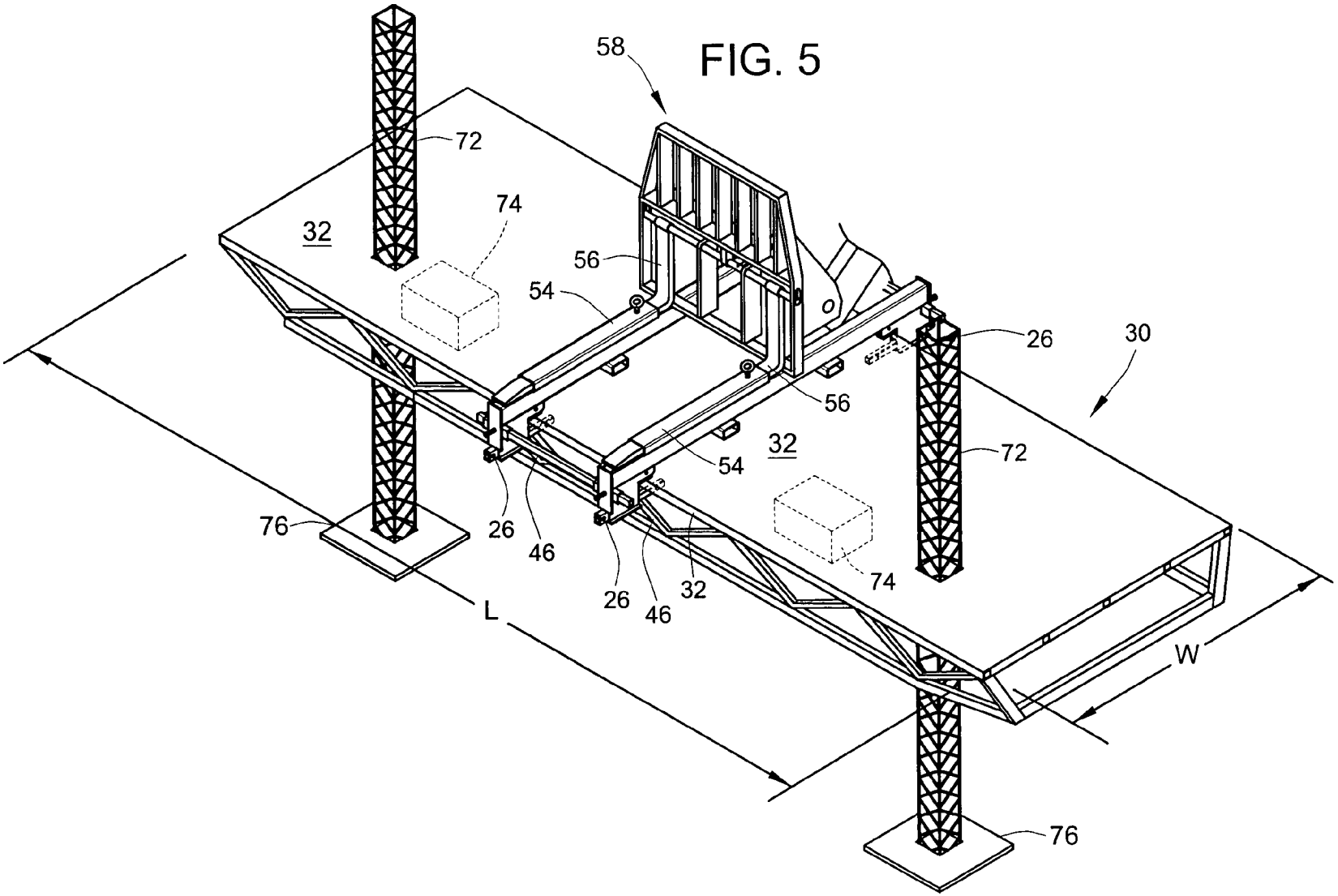
FIG. 5 is an isometric illustration of the lifting apparatus of FIG. 1 used with a forklift and attached to a scaffold unit.

While attached to the forklift tangs 56 using the tang receptacles 54, the lifting apparatus 20 may be positioned on top of and attached to a scaffold 30, as illustrated in the isometric view of FIG. 5. The end structure portions 26 secure the lifting apparatus 20 to the working platform 32 of the scaffold 30. The use of the end structure portions 26 to attach the lifting apparatus to the working platform 32 is a substantial benefit by allowing the lifting apparatus to be positioned substantially anywhere along the length, L, of the working platform 32. The lifting apparatus 20 thereby creates a connection between the scaffold 30 and the forklift tang 56. In this configuration the forklift tang 56, and consequently the forklift (not illustrated), is positioned perpendicular to the length of the working platform 32 of the scaffold 30. More importantly, the lifting structure 58 of the forklift may act from a position approximately centered over the scaffold 30, which greatly reduces the torque loading on the tangs 56 as will be discussed below. This orientation and the exceptional control provided by the rigidly secured end structure portions 26 assists positioning and maneuvering of the scaffold 30 and working platform 32, particularly, adjacent to a building or structure 62, as will be discussed more fully below with regard to FIG. 7. The forklift may be driven forward or backward to position the scaffold 30 closer or further from the structure 62, respectively.

To highlight a significant feature of the present invention, a prior method of lifting will be discussed briefly. As illustrated by the scaffold end profile view of FIG. 6, this previous method of lifting a scaffold 30 required that the forklift lift the scaffold 30 from the edge 64 of the working platform 32. This edge 64 is farthest from the hydraulic motors 74 and lifting towers 72, which are positioned next to the building or structure 62. Unfortunately, the center of mass 66 of the scaffold unit 30 is not located in the center of the scaffold, nor close to edge 64. Indeed, it is substantially offset from the center of the scaffold 30 towards edge 65 located near the building or structure 62 and away from the lifting structure 58 of the forklift. The center of mass 66 is offset from the center of the scaffold unit because the base scaffold unit 30 includes additional lifting components, including the lifting towers 72, lifting motors 74 and stabilization pads 76 located near edge 65.

Figure 6:
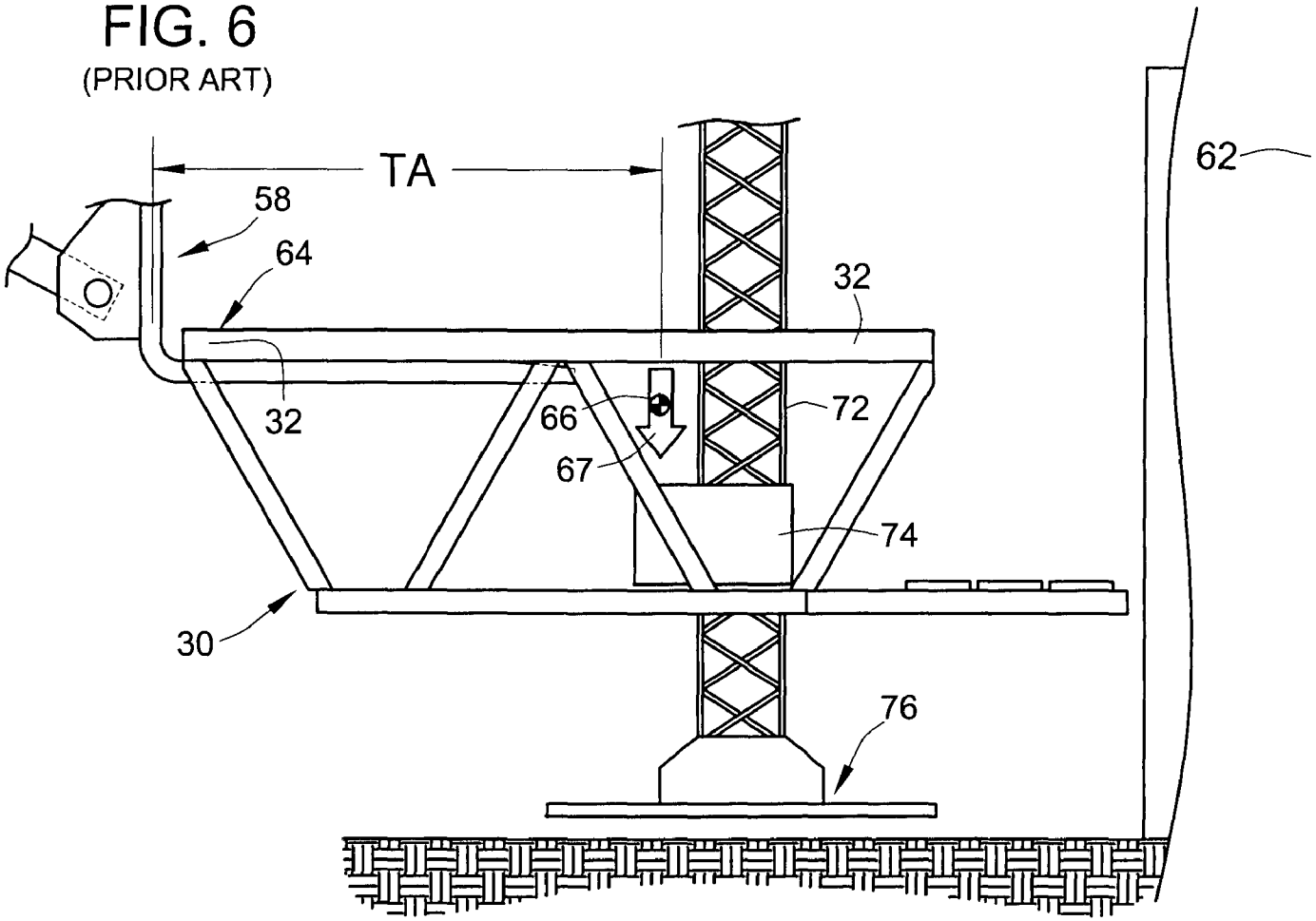
FIG. 6 (PRIOR ART)
FIG. 6 is a partial end view illustration of a scaffold lifted by the forklift tangs in accordance with the prior art.

As seen in this FIG. 6, a substantial torque arm TA is developed between the lifting structure 58 and the offset center of mass 66. The combination of the torque arm and weight 67 (illustrated as a downward arrow) of the scaffold unit 30 transmits a substantial torque to the lifting structure 58. This significant torque reduces the amount of weight that can be lift and can damage components of the forklift, such as bending tangs, fatigue and stress cracking of the lifting structure, etc. This potential damage is particularly acute when the forklift hits a bump or hole while moving the scaffold 30 at a worksite.

Advantageously, the lifting apparatus of the present invention significantly reduces this problem. As illustrated in FIG. 7, the offset position of the tang receptacles 54 greatly reduces the torque arm TA by positioning the lifting structure 58 substantially closer to the center of mass 66 of base scaffold unit. Furthermore, when lifting standard scaffold units that do not include the motors 74, towers 72, lifting pads 76, etc., the positioning of the lifting structure 58 is nearly in-line with the center of mass, nearly eliminating the torque arm developed while lifting these standard scaffold units. The torque transmitted to the lifting structure 58, by the weight 67 of the scaffold, is thereby substantially reduced. By reducing the resultant torque, maneuverability, control, and overall weight lifted may be significantly enhanced. In an alternative embodiment, the tang receptacles 54 are slidably and/or removably attached along the axis of the backbone portion 28 such that the position of the forklift tang receptacle 54 can be altered. This allows even more improved/preferred positioning of the lifting structure 58 relative to the center of mass 66 of the lifted scaffold 30.

Figure 8:
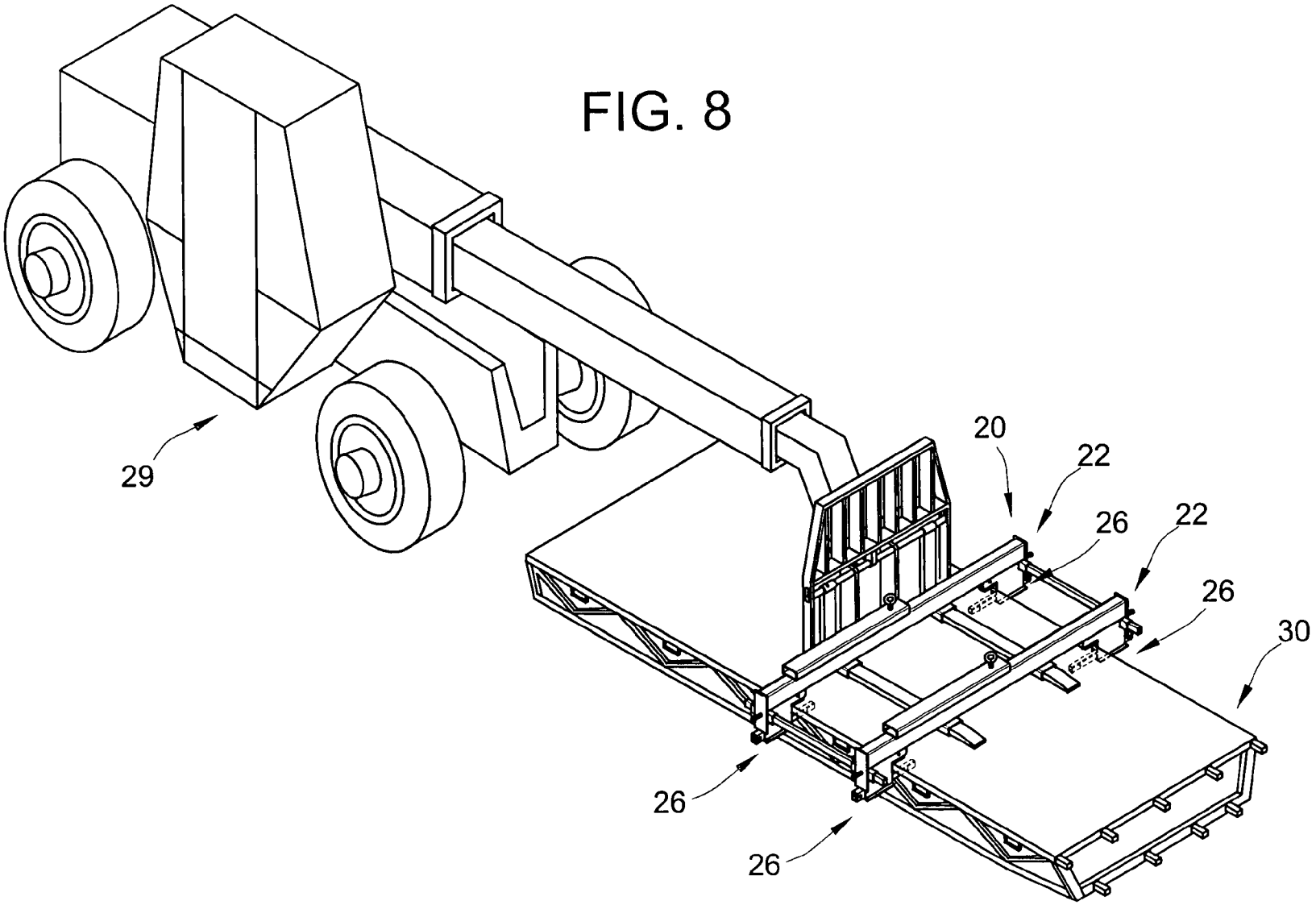
FIG. 8 is an isometric illustration of the lifting apparatus of FIG. 1 used with a forklift and attached to a scaffold unit transversely.

In addition to significantly aiding in the lifting and maneuvering of the scaffold, the apparatus of the present invention includes features that aid in the construction and destruction of the scaffold itself prior to and while the scaffold is in place at a worksite. Such construction allows the length of a base scaffold unit to be substantially increased by adding additional standard scaffold units or wings to the base unit. FIG. 8 is an isometric illustration of an embodiment of the lifting apparatus 20 of the present invention attached to a forklift 29 and a scaffold 30 in a configuration that assists in this construction process. Specifically, the lifting apparatus 20 is positioned on the scaffold 30 to balance the weight in relation to the lifting structure of the forklift 29. The forklift 29 is then able to lift and maneuver the scaffold unit 30 in a direction that is in-line with the length of the scaffold 30.

Figure 9:
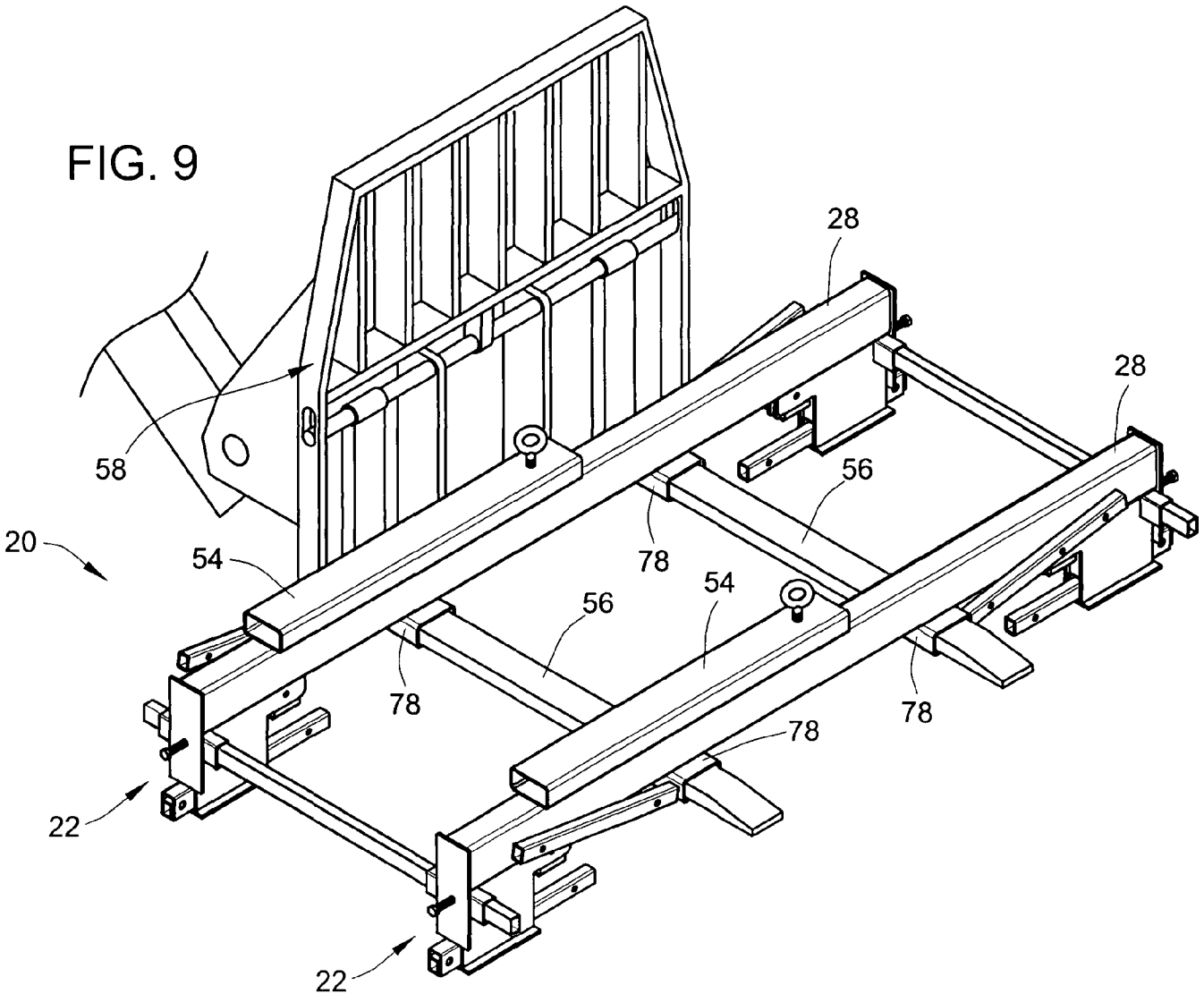
FIG. 9 is an isometric illustration of the lifting apparatus of FIG. 1 used with a forklift transversely.

Referring briefly to the isometric illustration of FIG. 9, the lifting apparatus 20 includes transverse tang receptacles 78 to accommodate the forklift tangs 56 and facilitate lifting the scaffold along its length to aid the construction of a scaffold assembly. In the illustrated embodiment, the transverse tang receptacles 78 are attached to the underside of the backbone portion 28 and are transverse thereto. Similar to the tang receptacle 54 previously described, the inner periphery of each transverse tang receptacle 78 preferably provides a close fit between the transverse tang receptacle 78 and an inserted forklift tang 56. The transverse tang receptacles 78 position the forklift tangs 56, and thereby the forklift, perpendicular to the portions 22 and the length of the scaffold to which the apparatus is attached. In an alternate embodiment, the transverse tang receptacles 78 are slidably and/or removably attached to the portions 22 such that the position of the transverse tang receptacles 78 can be altered. This allows the lifting apparatus 20 to accommodate the tangs of different forklifts.

Figure 10:
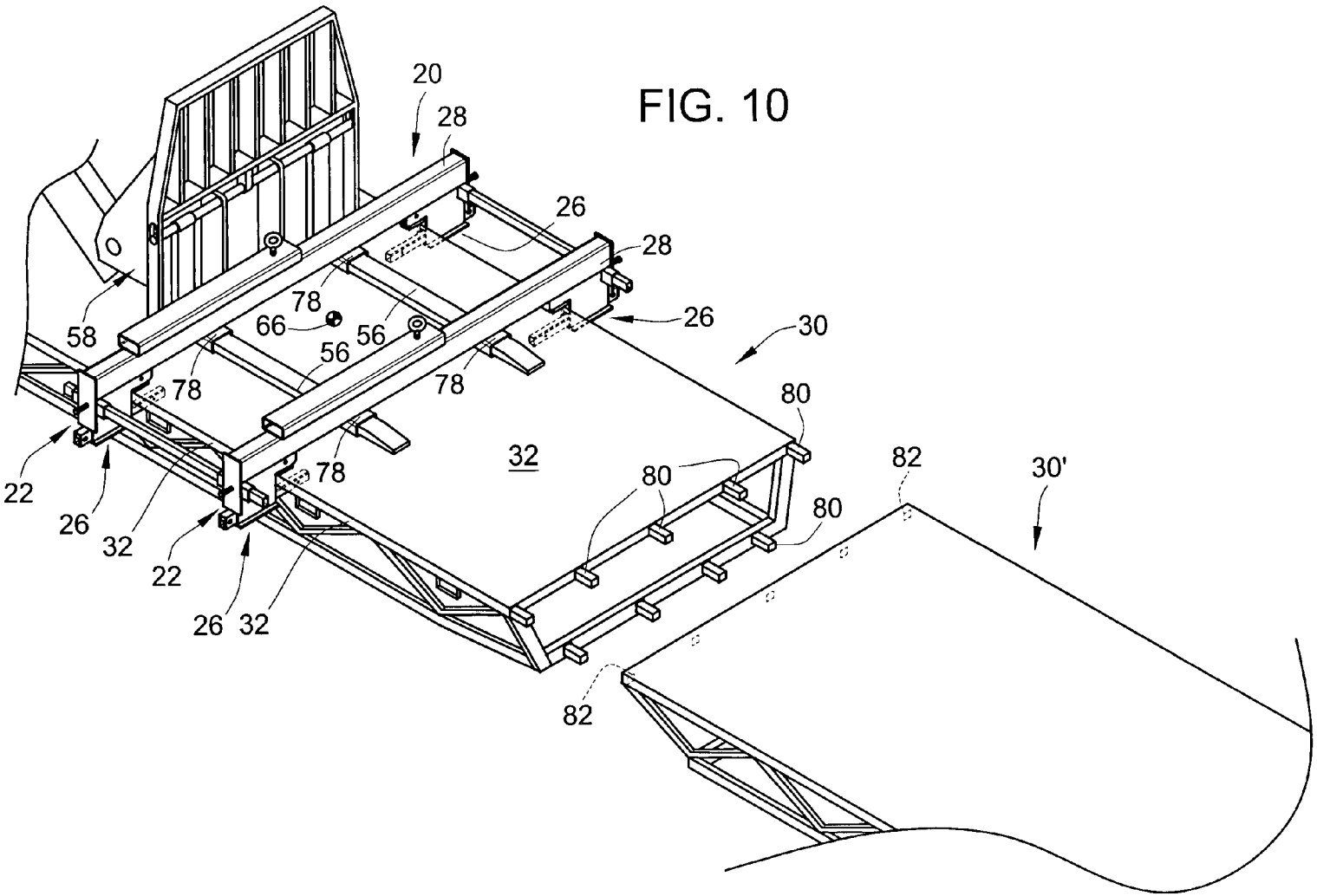
FIG. 10 is an isometric illustration of the lifting apparatus of FIG. 1 attached to a scaffold unit and used with a forklift to connect the attached scaffold unit to another scaffold unit.

Turning now to the isometric illustration of FIG. 10, the construction of the scaffold units 30 and 30' will now be discussed more fully. As illustrated, an embodiment of the lifting apparatus of the present invention is attached to a working platform 32 of a single scaffold unit 30. The forklift tangs 56 are inserted into the transverse tang receptacles 78 substantially parallel to the length of the working platform 32 and perpendicular to the backbone portions 28 of the lifting apparatus 20. To add stability and balance while lifting the scaffold unit 30 using this configuration, each portion 22 of the lifting apparatus 20 may be secured to the working platform 32, using the end structure portions 26, such that the lifting structure 58 is approximately centered over the center of mass 66 of the scaffold unit 30. In one embodiment of the disclosed invention, only a single portion 22 is used. In this configuration the single portion 22 would be positioned close to the center of mass 66 of the scaffold unit 30 to prevent substantial torque to be applied to the lifting apparatus 20 (the single portion 22).

The positioning provided by the transverse tang receptacles is extremely beneficial when connecting or disconnecting multiple scaffold units 30, 30'. Being parallel to the longitudinal length of the working platform 32, the forklift is also parallel to the plurality of scaffold connecting bars 80 of scaffold unit 30 which slide into the corresponding plurality of scaffold connecting bar receptacles 82 of scaffold unit 30' to secure the two scaffold units 30, 30' together. Because the end structure portions 26 securely and rigidly fix the lifting apparatus 20 to the working platform 32, scaffold unit 30 is easily controlled and maneuvered when performing tilting, lifting and positioning operations. The forklift and lifted scaffold unit 30 may be easily aligned with scaffold unit 30' such that scaffold units 30, 30' may be easily assembled or disassembled by simply driving the forklift forward or backward, respectively. Furthermore, the increased control over scaffold 30 allows a single person, the forklift operator, to perform the assembly or disassembly.

By rigidly attaching the scaffold to the forklift while aligning the forklift with the scaffold connecting bars 80 and connecting bar receptacles 82 the disclosed invention is a significant improvement over previous assembly or disassembly methods. These prior methods required hanging scaffold unit 30 from the forklift tangs 56 using chains. Because the chains provided loose non-rigid connections to the scaffold and provided limited and substantially uncontrolled maneuvering of scaffold 30 by the forklift, this method was inaccurate, difficult, dangerous and required numerous additional workers. One worker had to drive the forklift. A second worker had to steady and guide the scaffold that was hung from the forklift tangs. A third worker had to guide the scaffold connecting bars into the scaffold connecting bar receptacles.

During disassembly safety chains attached between the lifting apparatus 20 and forklift lifting structure 58 add additional control over the lifting apparatus 20 and facilitate pulling assembled scaffold units 30, 30' apart. In alternative embodiments, other mechanisms to improve control over the lifting apparatus 20 may be provided including pins, bolts, clamps, etc.

Figure 11:
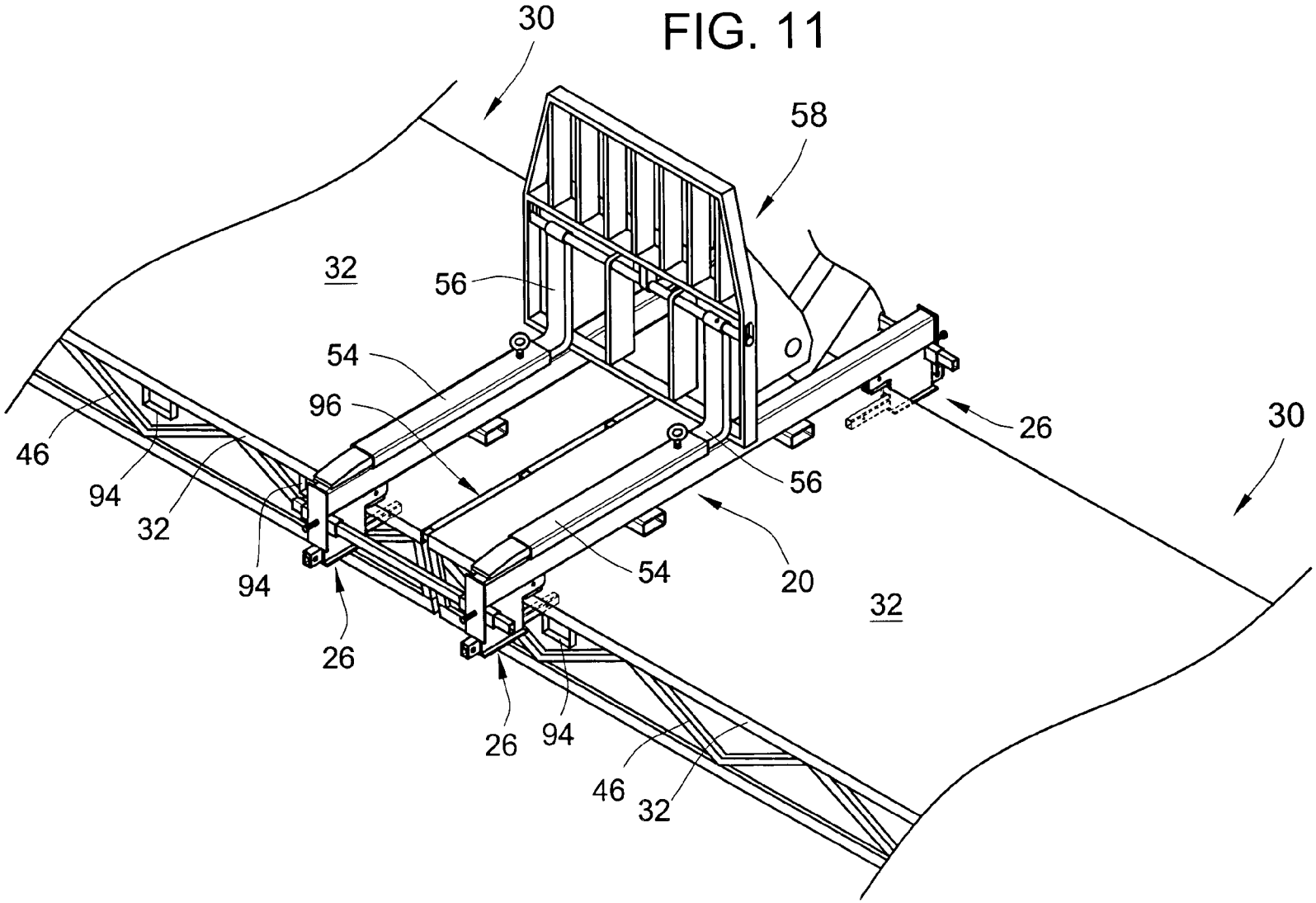
FIG. 11 is a partial isometric illustration of the lifting apparatus of FIG. 1 attached to a two-section scaffold assembly.

FIG. 11 is a partial isometric illustration of the lifting apparatus 20 attached to a scaffold assembly of two scaffold units. When lifting and maneuvering a scaffold assembly constructed from multiple scaffold units 30, the lifting apparatus 20 provides a secure lifting point for the forklift lifting structure 58 that allows lifting of the assembly without damaging either scaffold unit. Further, this lifting point may be positioned along the length of the assembly so that the load may be balanced. Previously, when the pre-installed scaffold tang receptacles 94 were used, damage to one of the scaffold sections would often result. This was because pre-installed scaffold tang receptacles 94 near the union 96 of the two sections are too far apart to accept both forklift tangs 56. Previously in these instances, a single forklift tang is inserted into one pre-installed scaffold tang receptacle 94 located near the union end of one scaffold unit 30. The other tang, which cannot be accommodated in the pre-installed scaffold tang receptacle 94 of the other scaffold unit, is placed under the working platform 32 of that other scaffold unit 30. As explained previously, this can result in substantial damage to structural support members 46 of the scaffold units 30. Because the end structure portions 26 may be attached to the scaffold 30 substantially anywhere along the length of the scaffold 30, as indicated previously, and are not limited to being positioned solely where the pre-installed scaffold tang receptacles 94 are positioned, this problem is eliminated or substantially reduced.

Figure 12:
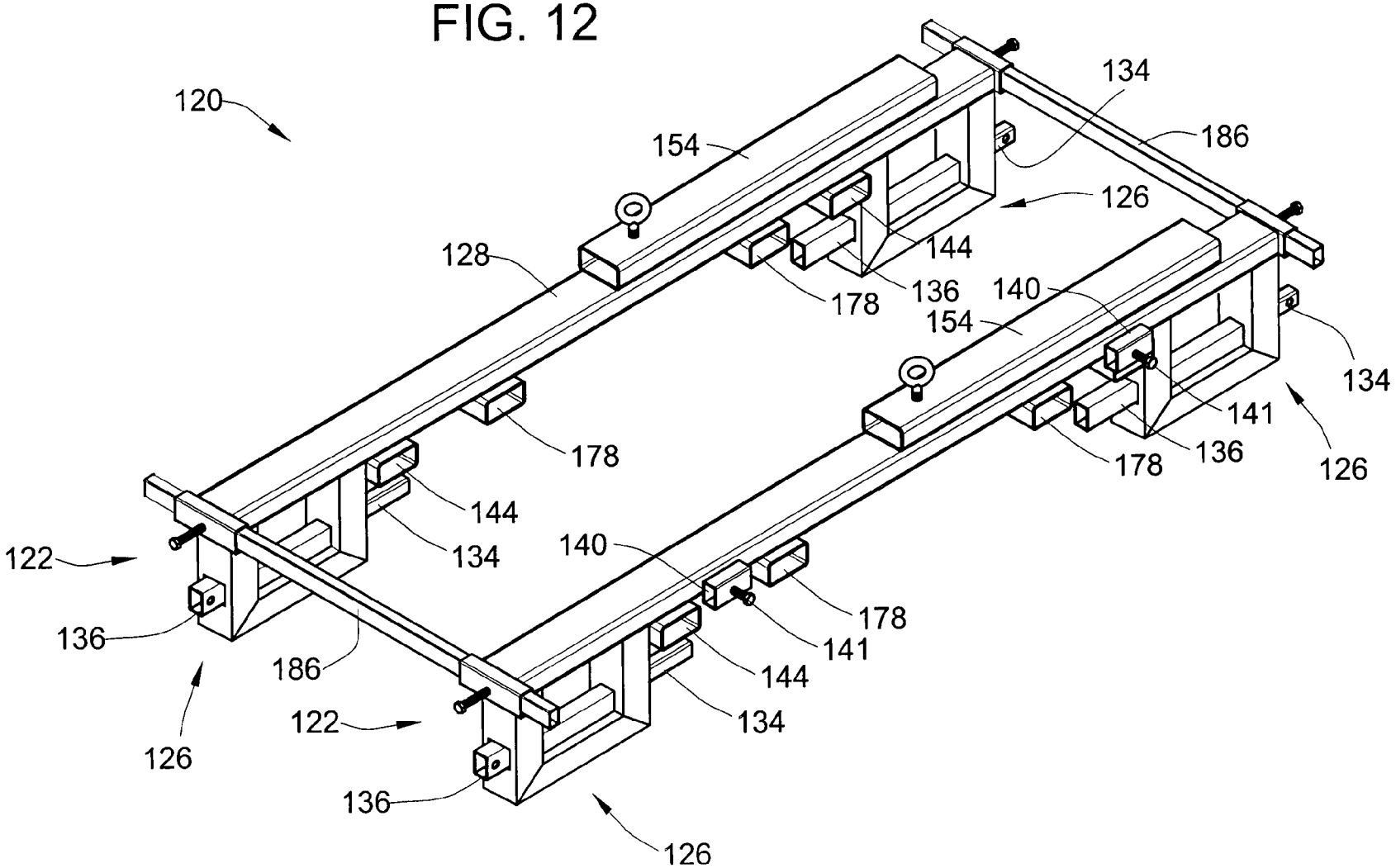
FIG. 12 is an isometric illustration of the an alternative embodiment of the lifting apparatus of FIG. 1.

Turning now to FIG. 12, there is illustrated an isometric view of an alternate embodiment of a lifting apparatus 120 constructed in accordance with the teachings of the present invention. This alternate embodiment is almost entirely defined by rectangular tubing. Each portion 122 of the lifting apparatus 120 includes two end structure portions 126 and a backbone portion 128. This embodiment also includes tang receptacles as well as transverse tang receptacles 168 for accommodating the tangs of a forklift. The top abutment surface 144 is formed by a section of rectangular tubing. The lifting bar holder 140 is also formed by a section of rectangular tubing. The lifting bar holder 140 includes a locking mechanism 141 to retain the lifting bar 136 therein when not carried in the lifting bar receptacle 136 of the end structure portion 126. This locking mechanism 141, as illustrated, is a bolt threaded through the side of the rectangular tubing, although other mechanisms may be used as recognized by those skilled in the art from the foregoing description of the present invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A lifting apparatus to facilitate lifting a scaffold using a forklift, comprising:

a first backbone portion adapted to accommodate a width of the scaffold;

a first pair of end structure portions affixed to the first backbone portion, each end structure portion adapted to secure the lifting apparatus to the scaffold; and at least one receptacle adapted to accommodate a tang of the forklift;

wherein the at least one receptacle comprises a tang receptacle attached to the backbone portion, the tang receptacle being oriented substantially parallel to the first backbone portion; and wherein a position of the tang receptacle is adjustable along a length of the first backbone portion.

2. The lifting apparatus of claim 1, further comprising a second backbone portion adapted to accommodate the width of the scaffold, a second pair of end structure portions affixed to the second backbone portion adapted to secure the lifting apparatus to a scaffold.

3. The lifting apparatus of claim 2, further comprising at least one cross-positioning bar holding the first backbone portion in relative position to the second backbone portion.

4. The lifting apparatus of claim 3, wherein each of the first and second backbone portions includes a cross-positioning bar receptacle adapted to slidably accommodate the at least one cross-positioning bar therethrough, and a locking mechanism to secure the cross-positioning bar therein, and wherein the relative position of the first backbone portion in relation to the second backbone portion is adjustable thereby.

5. The lifting apparatus of claim 1, further comprising a lifting bar, and wherein each end structure portion includes a lifting bar receptacle for removably accommodating the lifting bar therethrough, the lifting bar extending beyond the end structure in parallel spaced relation to the first backbone to accommodate a working platform of the scaffold therebetween to secure the lifting bracket assembly to the scaffold.

6. The lifting apparatus of claim 5, wherein the lifting bar is adapted to be removable from the lifting bar receptacle from either end of the lifting bar receptacle.

7. The lifting apparatus of claim 1, wherein the at least one receptacle further comprises a transverse tang receptacle attached to the first backbone portion, the transverse tang receptacle being oriented substantially perpendicular to the first backbone portion.

8. The lifting apparatus of claim 7, wherein a position of the transverse tang receptacle is adjustable along a length of the first backbone portion.

9. The lifting apparatus of claim 1, further comprising a support pad affixed to each end structure portion, the support pad having a width larger than a width of each end structure portion.

10. A lifting apparatus to facilitate lifting a scaffold using a forklift, comprising:

a first backbone portion adapted to accommodate a width of the scaffold;

a first pair of end structure portions affixed to the first backbone portion, each end structure portion adapted to secure the lifting apparatus to the scaffold;

at least one receptacle adapted to accommodate a tang of the forklift; and a lifting bar; and wherein each end structure portion includes a lifting bar receptacle for removably accommodating the lifting bar therethrough, the lifting bar extending beyond the end structure in parallel spaced relation to the first backbone to accommodate a working platform of the scaffold therebetween to secure the lifting bracket assembly to the scaffold; and wherein each end structure portion includes a top abutment surface, and wherein the working platform of the scaffold is closely accommodated between the top abutment surface and the lifting bar when the lifting bracket assembly is secured to the scaffold.

11. The lifting apparatus of claim 10, wherein the top abutment surface comprises at least one shim having a thickness adapted to vary a gap between the top abutment surface and the lifting bar to closely accommodate working platforms of varying thicknesses.

12. A lifting apparatus to facilitate lifting a scaffold using a forklift, comprising:

a first backbone portion adapted to accommodate a width of the scaffold;

a first pair of end structure portions affixed to the first backbone portion, each end structure portion adapted to secure the lifting apparatus to the scaffold; and at least one receptacle adapted to accommodate a tang of the forklift; and wherein the at least one receptacle is slidably attached to the backbone portion.

13. The lifting apparatus of claim 12, further comprising a lifting bar holder coupled to the first backbone portion adapted to secure the lifting bar to the lifting apparatus.

14. A lifting apparatus, comprising a ridged backbone structure having end portions extending perpendicular thereto a length sufficient to accommodate a depth of a load to be lifted, each end portion defining a lifting bar receptacle therethrough for removably receiving a lifting bar, the lifting bar receptacle being positioned a vertical distance from the backbone structure to accommodate a depth of a load to be lifted, the lifting bar having a length sufficient to extend beyond the lifting bar receptacle to position the load to be lifted between the lifting bar and the backbone structure, and a forklift tang receptacle attached to the backbone structure, and wherein the forklift tang receptacle is positioned to accept a forklift tang along a length of the backbone structure, the forklift tang receptacle having an opening near a center of the backbone structure to allow lifting of a load near a center of mass of the load.

15. The lifting apparatus of claim 14, wherein the a position of the forklift tang receptacle is adjustable along the length of the backbone.

16. The lifting apparatus of claim 14, further comprising a transverse forklift tang receptacle positioned to accept a forklift tang perpendicular to a length of the backbone structure, the transverse forklift tang receptacle allowing lifting of a load along a length of the load.

17. The lifting apparatus of claim 14, further comprising a second ridged backbone structure having second end portions extending perpendicular thereto a length sufficient to accommodate a depth of the load to be lifted, each second end portion defining a second lifting bar receptacle therethrough for removably receiving a second lifting bar, the second lifting bar receptacle being positioned a vertical distance from the second backbone structure to accommodate the depth of the load to be lifted, the second lifting bar having a second length sufficient to extend beyond the second lifting bar receptacle to position the load to be lifted between the second lifting bar and the second backbone structure, and a second forklift tang receptacle attached to the second backbone structure, and at least one cross-positioning bar coupled between the backbone structure and the second backbone structure to maintain a relative distance therebetween.

* * * * *